US005885168A

United States Patent [19]

Bair

[11] Patent Number: 5,885,168

[45] **Date of Patent: *Mar. 23, 1999**

[54] GOLF PLAYING SURFACE ASSEMBLY

[76] Inventor: Carl J. Bair, 12625 Danielson Ct, #108, Poway, Calif. 92064

[ * ] Notice: The term of this patent shall not extend beyond the expiration date of Pat. No. 5,655,974.

[21] Appl. No.: 855,041

[22] Filed: May 13, 1997

Related U.S. Application Data

[63] Continuation-in-part of Ser. No. 696,331, Aug. 13, 1996, Pat. No. 5,655,974.

[51] Int. Cl.[6] ..... A63B 69/36

[52] U.S. Cl. ..... 473/278; 473/262

[58] Field of Search ..... 473/278, 279, 473/171, 262

[56] References Cited

U.S. PATENT DOCUMENTS

| | | | |
|---|---|---|---|
| 1,856,259 | 5/1932 | Lyons | 473/278 X |
| 3,633,917 | 1/1972 | Anderson | 473/279 |
| 5,004,243 | 4/1991 | Dloughy | 473/279 |
| 5,292,130 | 3/1994 | Hooper | 473/279 |
| 5,645,494 | 7/1997 | Dionne et al. | 473/278 |
| 5,655,974 | 8/1997 | Bair | 473/278 |

*Primary Examiner*—George J. Marlo

*Attorney, Agent, or Firm*—Brown, Martin, Haller & McClain, LLP

[57] ABSTRACT

A golf ball playing surface assembly includes a plurality of different mats having different surfaces for simulating different golf playing surface conditions. A playing surface in a golf simulator, hitting bay or practice area is provided with a rectangular recess of predetermined depth, length and width. The mats have different piles for simulating different playing surface conditions, and can be placed side by side in any selected configuration in the recess to cover at least a major portion of the recess area. The depth of the recess is substantially equal to the height of at least some of the mats, so that a hitting surface is provided which is substantially flush with the surrounding floor area. Different combinations of mats can be placed in the recess to simulate different playing conditions.

16 Claims, 4 Drawing Sheets

GOLF PLAYING SURFACE ASSEMBLY

CROSS-REFERENCE TO RELATED APPLICATION

This application is a continuation-in-part of application Ser. No. 08/696,331 of Carl J. Bair, which was filed on Aug. 13, 1996 now U.S. Pat. No. 5,655,974.

BACKGROUND OF THE INVENTION

The present invention relates generally to artificial playing surfaces for use in golf ball driving ranges, golf simulators, golf ball hitting bays and the like.

Golf simulators are becoming increasingly popular for allowing players to practice their game in an indoor facility. These arrangements permit playing, training and practice regardless of outdoor weather conditions. In a typical golf simulator, a playing enclosure is provided with a full wall screen at one end onto which views of a golf course are projected. In such golf simulators, as well as in indoor golf ball hitting bays and the like, a floor area is designated for the player to hit the ball. Typically, a foam-backed hitting mat is placed on top of the floor surface in this area. Although the mat may be a carpet or other brush-like mat of short, medium or heavy weight for simulating different playing surfaces, this arrangement is not ideal since the ball hitting area is elevated above the surrounding floor surface on which the player stands, and therefore does not give a realistic feel of a real golf ball hitting environment. If putting is involved, the player must either hit off from a raised mat, which is undesirable, or move off from the main hitting area to put the ball in a level and more realistic environment. Additionally, such mats typically wear out fairly rapidly.

SUMMARY OF THE INVENTION

It is an object of the present invention to provide a golf ball playing surface assembly for more realistically simulating an actual playing environment.

According to one aspect of the present invention, a golf ball playing surface assembly is provided, which comprises a playing surface for golf having a rectangular recess of predetermined depth, length and width, and a plurality of different mats for selectively placing side by side in the recess to simulate different playing conditions. The mats comprise a first mat having a first surface simulating a tee area which is substantially flush with the playing surface surrounding the recess, and at least a second mat having a second surface different from the first surface for simulating a different golf playing condition. The mats are preferably dimensioned such that a plurality of mats can be arranged to substantially fill at least a major portion of the recess.

Preferably, at least four different mats are provided, comprising the first and second mats, and third and fourth mats each having different surface textures for simulating different playing conditions. For example, the second mat surface may simulate rough, the third mat surface may simulate fairway conditions, and the fourth mat may simulate sand conditions. The mats will have different pile depths and/or densities for simulating the different playing conditions. Each mat may comprise a single piece of carpet or mat-like material, or may be made up of several unitary panels.

In a preferred embodiment of the invention, the first mat is a one-piece panel of width substantially equal to the width of the recess and length less than the length of the recess, so that at least one first mat may be placed in the recess to simulate a tee area, and other mats may be placed in the remainder of the recess. The second, third and fourth mats may each be made up of unitary square panels having different pile depths or densities. Optionally, some panels may have only a single pile depth and others may be half one pile depth, and half another pile depth, for greater flexibility in arranging the playing surface layout.

One or more first mats may be placed in the recess so as to cover a major portion of the recess, leaving an open area at one or both ends of the recess. In this region, panels of different pile depth may be placed side by side to simulate different playing conditions.

This invention provides a very large variety of easy to change playing surface configurations, in combination with a standing/putting surface which is flush with the surrounding floor surface so as to more accurately simulate putting or teeing off conditions on an actual golf course. The mats can be moved or replaced quickly and easily in order to change playing surface conditions or replace worn mats.

BRIEF DESCRIPTION OF THE DRAWINGS

Some preferred embodiments of the present invention will now be described by way of example only with reference to the accompanying drawings, in which like reference numerals refer to like parts, and in which.

DESCRIPTION OF THE PREFERRED EMBODIMENTS

Figure 1:
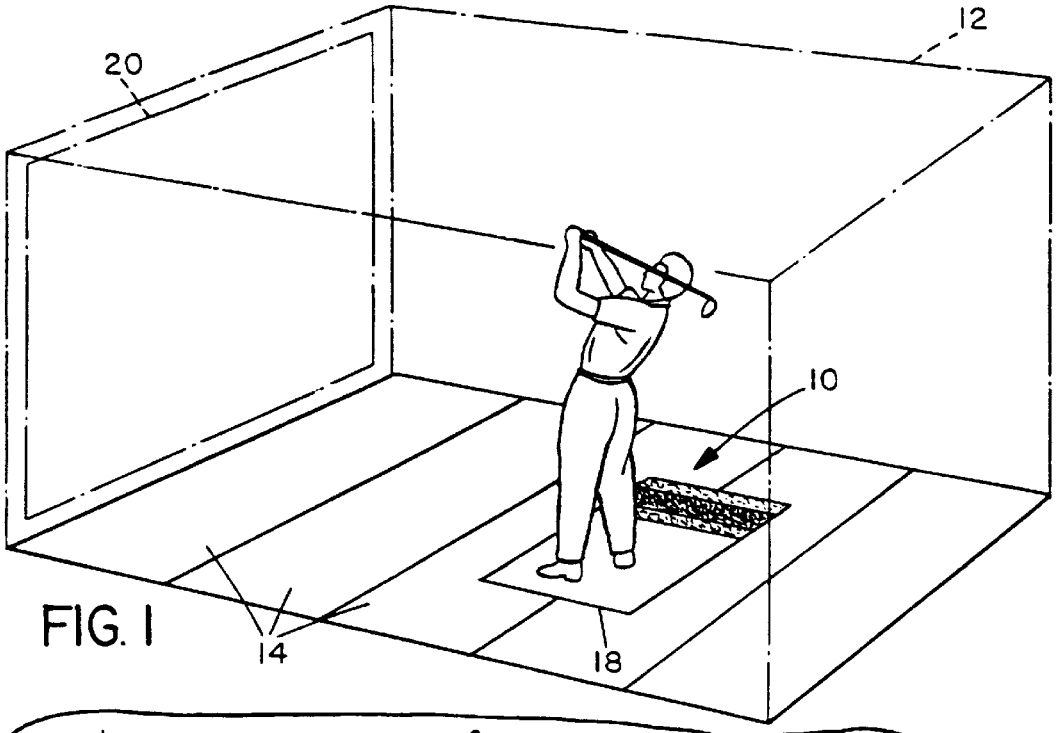
FIG. 1 is a pictorial view of a typical simulated golf installation, showing a playing surface assembly according to a first embodiment of the present invention.
Figure 3:
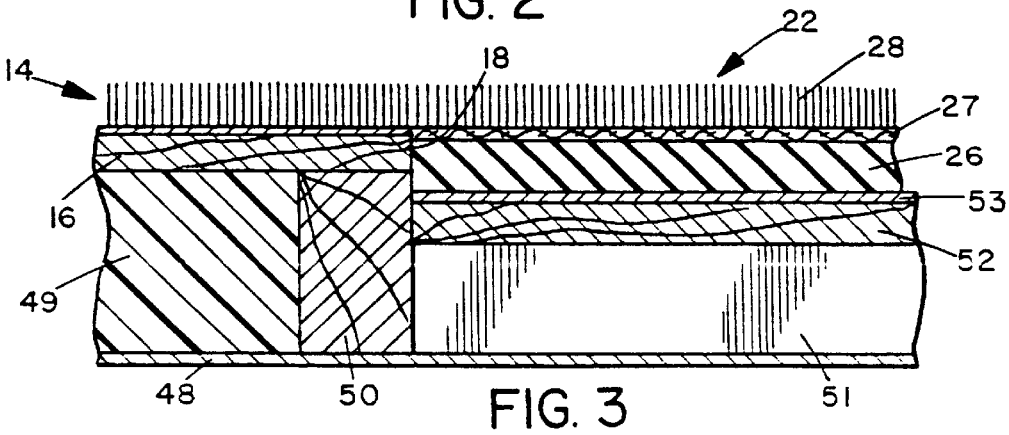
FIG. 3 is an enlarged sectional view taken on line 3—3 of FIG. 2.

FIG. 1 illustrates a playing surface assembly 10 according to a first embodiment of the present invention, forming part of a golf simulator 12. Although the surface assembly 10 is incorporated in a golf simulator in the illustrated embodiment, it will be understood that it may alternatively be used in other golf ball hitting areas outside of a conventional golf course, such as golf ball driving ranges and golf ball hitting bays. In a typical golf simulator or other simulated hitting area, a playing surface is formed from a series of floor panels 14 which are typically of Astroturf® or the like laid on ½" plywood flooring 16, as best illustrated in FIG. 3. A rectangular recessed area 18 is formed in the playing surface at an appropriate position corresponding to the normal hitting position of a player using the simulator, driving range or bay. In the golf simulator illustrated in FIG. 1, the recessed area 18 is formed between the third and fourth floor panels from the screen end 20 of the simulator. It will be understood that such a recessed area may be formed as desired in other playing surfaces such as cement floors or the like.

Figure 8:
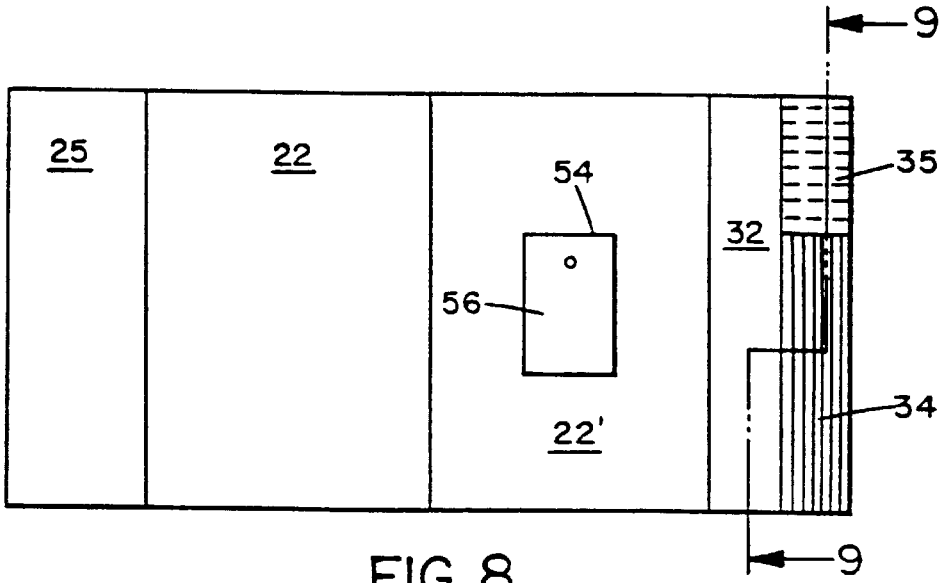
FIG. 8 is a top view of another alternative configuration.
Figure 9:
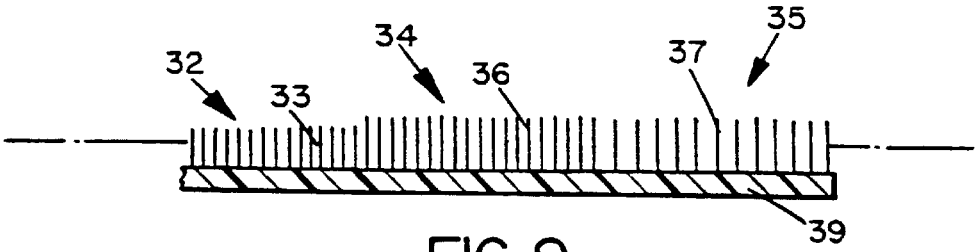
FIG. 9 is a sectional view taken along line 9—9 of FIG. 8.

A plurality of different mats 22,23,24 and 25 defining different stance or playing surfaces are provided for selectively placing in the recessed area to form different playing surfaces 10 dependent on the desired playing conditions. Each of the mats may be cut in a single piece, or made up of a series of unitary panels, as is well known in the carpet-laying field. Some possible configurations and mat combinations are illustrated by way of example in FIGS. 2, 4, 6 and 8. However, it will be understood that various other configurations are possible. The mats 22 and 25 are preferably of foam-backed Astroturf®, although other foam-backed, carpet-like materials may alternatively be used for these mats. Mats 23 and 24 are preferably nylon brush mats. Mats 22 and 25 have a uniform pile density and depth to simulate short grass as found in a tee area, as in conventional Astroturf®, but the mats 23 and 24 have regions of different pile density and depth for simulating different playing conditions, as best illustrated in FIGS. 8 and 9 and described in more detail below. It will be understood that the mats 23 and 24 with regions of different surface texture may be made up of plural, unitary panels with the appropriate surfaces, as described in more detail below in connection with FIGS. 10–14.

Figure 2:
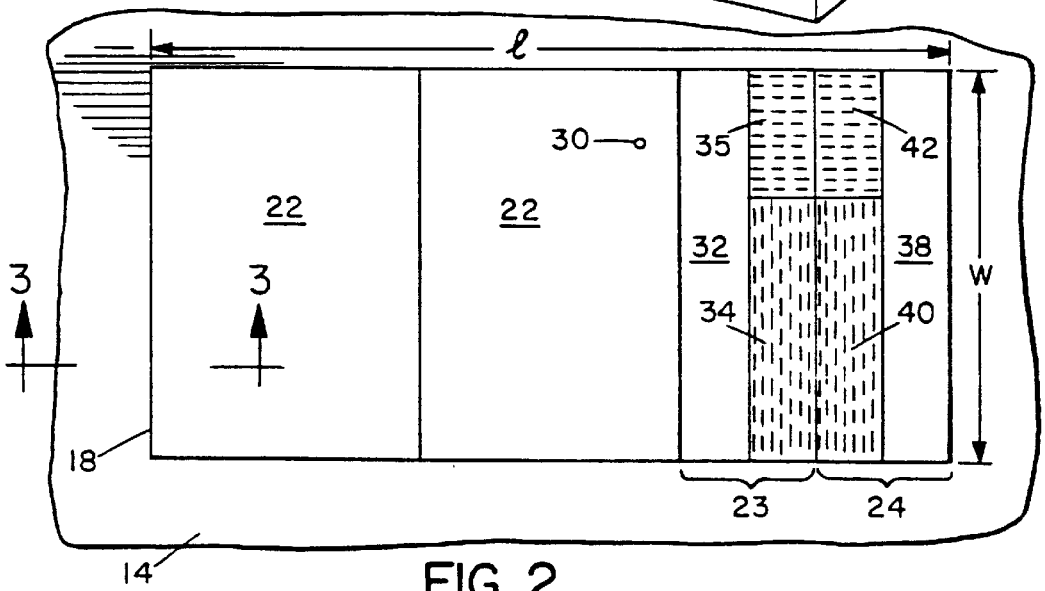
FIG. 2 is an enlarged top view of the surface assembly, showing one arrangement of the mats.

Assuming that recessed area 18 has a length l and width w, as indicated in FIG. 2, each of the rectangular mats 22,23,24 and 25 has a longer dimension or length which is equal to width w, and a shorter dimension or width which is less than dimension 1. For example, if mat 22 has a width a, and mats 23,24 and 25 each have a width b, then $1=2a+2b$. Thus, a plurality of different arrangements of two of the mats 22 and any two of the mats 23,24 or 25 are possible for fitting in and covering the entire recessed area 18. Four of the many possible alternatives are illustrated in FIGS. 2, 4, 6 and 8, respectively.

Mats 22 and 25 are each brush- or carpet-like mats having a foam backing layer 26, a fiber base 27, and a tight pile 28 of a relatively low depth for simulating fairway or putting conditions, as best illustrated in FIG. 3. These are intended to be used as stance mats for the player 30 to stand on while striking the ball, as indicated generally in FIG. 1, or as a tee or putting area. However, mat 25 is narrower than mat 22, as illustrated in FIG. 8, which illustrates a combination utilizing both mats 22 and 25. The depth of recessed area 18 is designed such that when the stance mats 22 or 25 are placed in the recess, the pile 28 will be substantially flush with the pile of the surrounding floor panel surface, as indicated in FIG. 3. A golf tee 30 may be inserted through the pile 28 into the foam backing layer 26 at any desired position. Alternatively, a ball may be placed directly onto the pile to simulate putting.

Mats 23 and 24 are plastic brush mats with plastic tufts embedded in a plastic base 39. Suitable brush mats are made by Fiberbuilt Corporation of Canada. In each mat, regions or panels of different pile depth and density are provided for simulating different types of playing surface. Mat 23 has a first strip 32 which may be made up of two or more unitary panels with brush or pile 33 of a first depth deeper than that of mats 22 and 25 and covering half of the area 23. Strip 32 is designed to simulate fairway and will have a pile density less than that of the stance mats 22 and 25. Strip 32 is located on the left-hand side of area 23. The other, right-hand half of the mat area 23 is divided into two regions 34,35, the first of which has one or more panels with a pile 36 of a second depth deeper than that of pile 33, and the second of which has one or more panels of pile 37 of equivalent depth to pile 36, but with looser fibers or reduced pile density, as best illustrated in FIGS. 8 and 9. The pile density in region 34 is less than that in strip 32, and the pile density in region 35 is less than that in region 34. The first region 34 is for simulating rough, and the second region 35, which is smaller than region 34, simulates playing in sand traps. Due to the looser pile in region 35, a ball will sit deeper into the pile in this region, providing a simulation of a sand trap.

Mat 24 is similar to mat 23, but the playing regions are reversed. Thus, mat 24 has a strip 38 on the right-hand side with a pile of the same depth as pile 33 for simulating fairway, a first region 40 on the left-hand side with a pile of the same depth as pile 36 for simulating rough, and a second region 42 with a pile of the same depth as pile 37 for simulating sand. Again, each of these regions may be formed by one or more unitary panels of the appropriate pile depth and density. When the two mats are placed side by side with mat 23 on the left, as in FIG. 2, regions 34 and 40 combine to form a wider rough simulating area and regions 35 and 42 combine to form a wider sand simulating area. The different piles are of different depth and also of different tuft tightness for simulating the various playing conditions. Thus, mats 22 and 25 have a short, tight pile, areas 32 and 38 have a slightly deeper, looser pile, areas 34 and 40 are of heavier weight, deeper pile, and areas 35 and 42 have looser pile of the same depth as areas 34 and 40.

As best illustrated in FIG. 3, the floor of a golf simulator generally consists of ½" plywood flooring panels with 2" by 3" boards around the edges and a fiberboard base 48, with foamed material 49 between the flooring panels and base 48. The recessed area will be suitably cut at an appropriate position, and bordered with 2" by 3" boards 50 as illustrated in FIG. 3. A series of 2" by 3" boards 51 are then laid flat in the bottom of the recess, and a ½" plywood flooring panel 52 is laid on top of the boards 51. A ⅛" layer 53 of masonite is then placed on top of panel 52, forming the bottom of the recessed area. The selected mats will be placed on top of layer 53, as illustrated in FIG. 3.

As noted above, FIGS. 2, 4, 6 and 8 illustrate three possible arrangements of the mats. However, it will be understood that many other alternatives are possible simply by rearranging the mat positions and using different combinations of mats. In FIG. 2, two stance mats 22 are placed side by side starting at one end of recessed area 18, and mat regions 23 and 24 are then formed to fill the right-hand end of the recessed area, with mat region 23 on the left-hand side. This allows the player to tee off or putt from mats 22, which are substantially level with the surrounding floor surface, and to play the ball from a surface simulating fairway, a surface simulating rough, or a surface simulating sand. The arrangement in FIG. 2 will be particularly suitable where the player is right handed. If the player is left handed, they simply reverse the arrangement of FIG. 2 to place the mat regions 23,24 at the left-hand end of recessed area 18. In another alternative which is not illustrated, mats 23 and 24 may be replaced with two mats 25 to provide an all stance mat configuration. In another alternative, the mat regions 23,24 may be reversed, with mat region 23 on the right-hand side and mat region or layout 24 on the left. This will provide an enlarged fairway area at the center, since the two strips 32 and 38 which simulate fairway conditions will be side by side.

Figure 4:
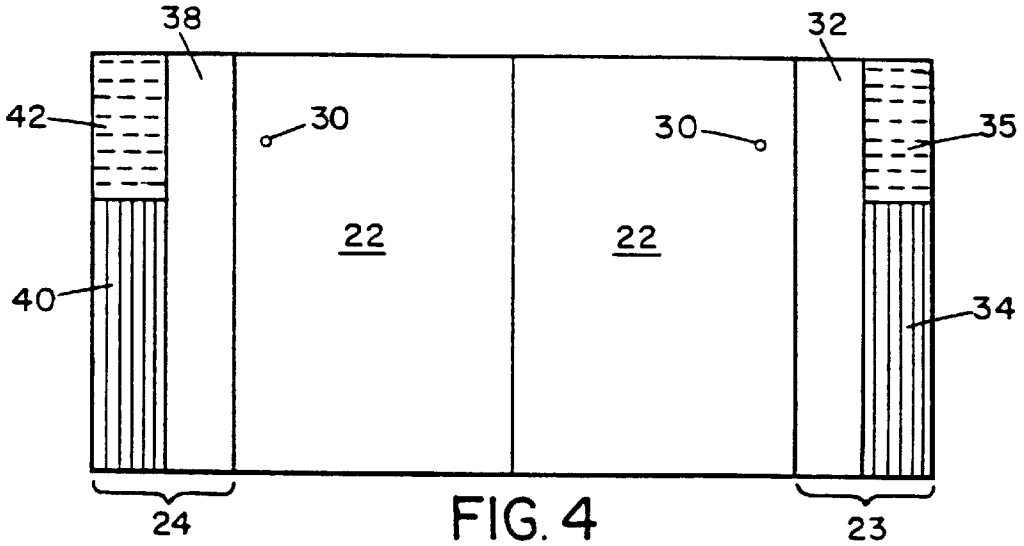
FIG. 4 is a top plan view of an alternative arrangement of the mats.
Figure 5:
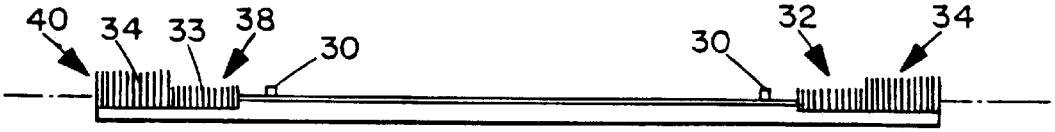
FIG. 5 is an edge view of the mats of FIG. 4.

FIGS. 4 and 5 illustrate another alternative configuration where the two stance mats 22 are placed at the center of the recessed area, with a mat 24 at the left-hand end and mat 23 at the right-hand end, when viewed in a direction facing towards the screen. This permits playing by either left- or right-handed players with the same basis mat arrangement. In an alternative arrangement, the mats 23 and 24 may be reversed, with mat 23 at the left and mat 24 at the right-hand end of the recessed area.

Figure 6:
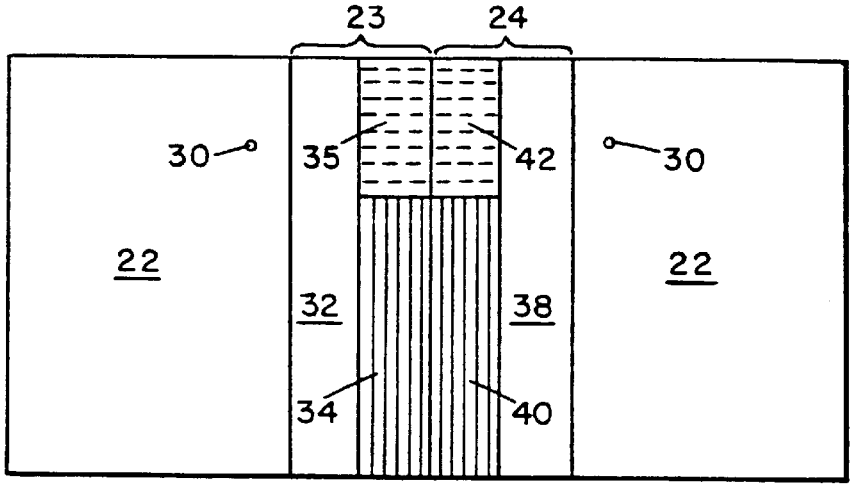
FIG. 6 is a top plan view of a further configuration of the mats.
Figure 7:
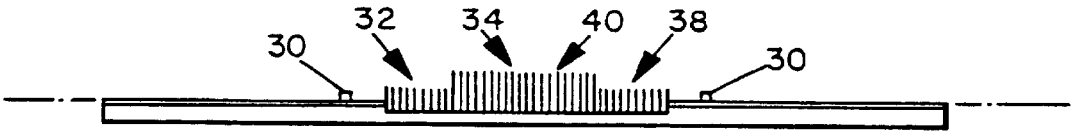
FIG. 7 is an edge view of the mats of FIG. 6.

FIGS. 6 and 7 illustrate another possible configuration of the various mats to form a different playing surface. In this configuration, two stance mats 22 are placed at opposite ends of the recess, and mats 23 and 24 are placed at the center, with the mat 23 on the left of mat 24. Again, this will permit use by both left- and right-handed players on the same playing surface, using the opposite stance mats. This configuration provides a useful basic playing surface for either-handed players, having an enlarged rough and sand area at the center of the playing surface. If desired, mats 23 and 24 may be reversed to provide an enlarged fairway area by positioning areas 32 and 38 side by side.

FIG. 8 illustrates another alternative playing surface configuration made up of one stance mat 22, a modified stance mat 22', one of the narrower stance mats 25, and mat 23. This provides an enlarged stance mat area over the previous configurations. In this alternative, one of the wider stance mats 22' is modified to provide a recess or cut-out 54 for receiving a conventional golf swing analyzer 56. Mat 22' will therefore be used whenever a player wishes to use a golf swing analyzer. The combined area of stance mats 22 and 25 may be used for the player to stand and also for a putting surface. The arrangement may be reversed for left-handed players.

Figure 10:
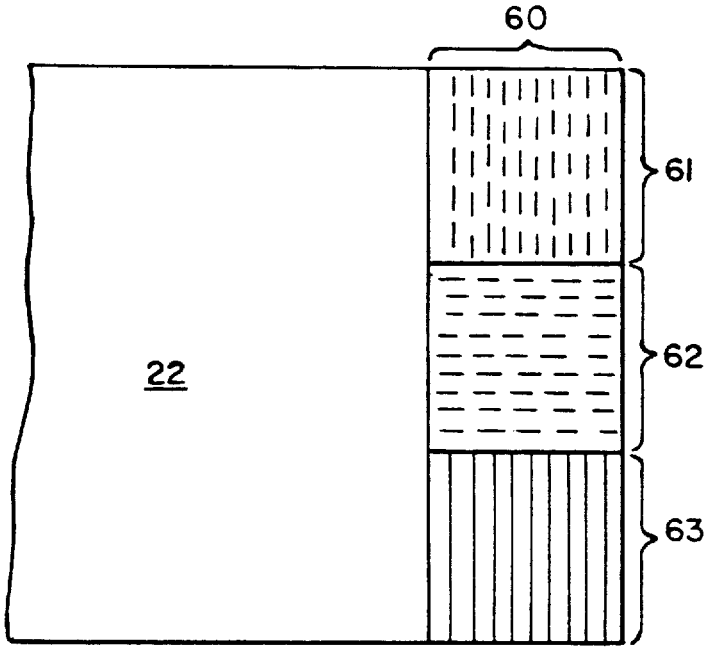
FIG. 10 is an enlarged top view of part of a playing surface assembly showing an alternative mat arrangement.
Figure 12:
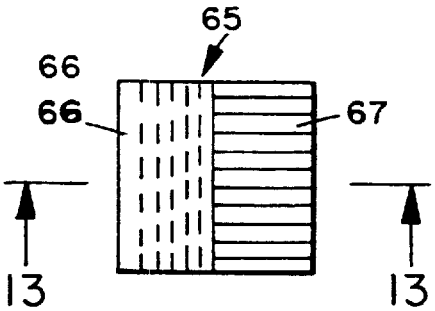
FIG. 12 is a top plan view of a mat panel having two different playing surfaces.
Figure 14:
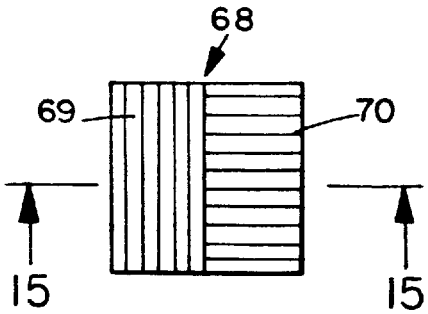
FIG. 14 is a top plan view of another type of mat panel for use in the assembly.
Figure 13:
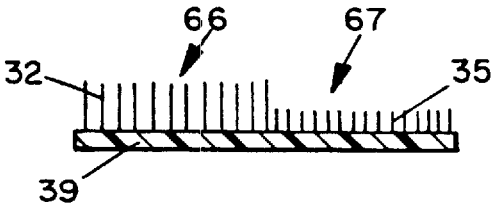
FIG. 13 is a section on the lines 13—13 of FIG. 12.
Figure 15:
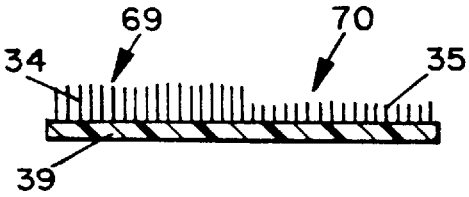
FIG. 15 is a section on the lines 15—15 of FIG. 14.

FIG. 10 illustrates another modified playing surface arrangement for positioning in the recess 18 of the previous embodiments. In this arrangement, one or more foam-backed stance mats are positioned to fill the majority of the recess, so as to leave a strip-like region 60 at one or both ends of the recess. A brush-like mat surface with regions 61,62,63 having a different pile depth and/or density is placed in region 60. As in the previous embodiment, this may comprise a single piece of mat material having different pile textures in different areas corresponding to regions 61,62,63 or, preferably, three different mat panels each having a different pile texture, as specifically indicated in FIG. 10. Thus, mat panel 61 may have low density pile 37 for simulating sand as described above in connection with FIG. 9, while mat panel 62 may have a shorter, higher density pile 33 as in FIG. 9 for simulating fairway conditions, and mat panel 63 may have a pile 36 as in FIG. 9 of the same height as pile 37 but higher density for simulating rough. It will be understood that the arrangement of FIG. 10 is by way of example only and other configurations are possible, such as one mat panel 61 and two mat panels 63, three mat panels 62, one mat panel 61 and two panels 62, and so on, depending on the desired playing surface conditions. One or more of the mat panels may be removed if desired, leaving a recessed area lower than the surrounding floor, which could readily be used as a receptacle for convenient storage of golf balls, making them readily available to the golfer.

Figure 11:
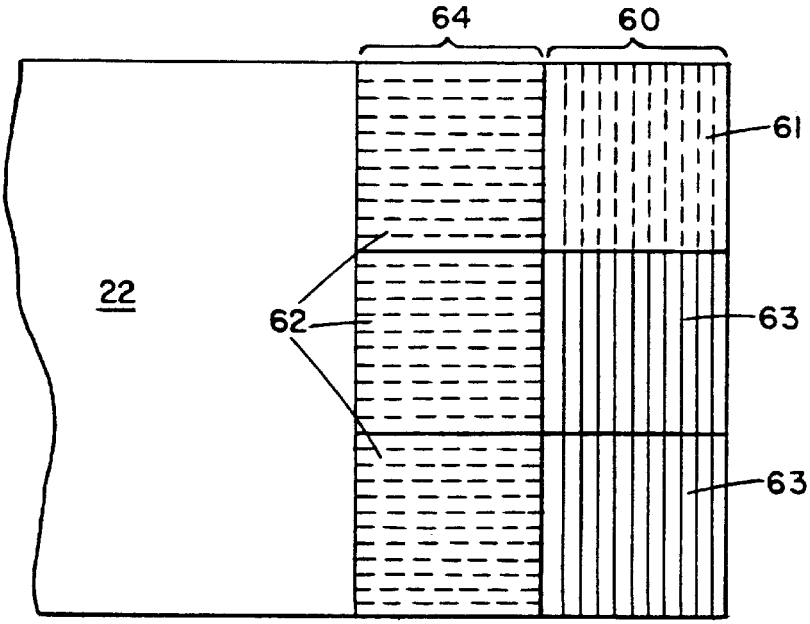
FIG. 11 is an enlarged top view similar to FIG. 10 illustrating a modified configuration.

Also, instead of one strip-like region 60 at one or both ends of the recess, the dimensions may be such that two strip-like regions 60 and 64 may be provided at one or both ends, as illustrated in FIG. 11, and similar to the configurations of FIGS. 1–9. FIG. 11 illustrates one out of many possible playing surface arrangements made up of a selection of the mat panels 61,62 and 63. In this arrangement, the first strip-like region 60 is made up of one sand simulating mat panel 61 and two rough simulating panels 63, and the second strip-like region 64 is made up of three fairway simulating panels 62. In the arrangement illustrated, three unitary mat panels are sufficient to span the width of recess 18. However, it will be understood that the recess may be of any desired dimensions and may permit four or more mat panels to fit across the width of the recess.

Although the unitary mat panels 61,62 and 63 each have only a single type of pile, additional mat panels may be provided in which half of the panel has one type of pile and the other half of the panel has a different type of pile. Two possible examples of such mat panels are illustrated in FIGS. 12–15. Mat panel 65 of FIGS. 12 and 13 has one half 66 with pile 32 for simulating sand, and one half 67 with pile 35 for simulating fairway. Mat panel 68 of FIGS. 14 and 15 has one half 69 with pile 34 for simulating rough and one half 70 with pile 35 for simulating fairway. Another mat panel (not illustrated) will be provided with half having a pile 32 for simulating sand and the other half having a pile 34 for simulating rough. These mat panels may be used in combination with the single pile panels 61,62 and 63 to provide a very large range of different possible surface combinations.

It will be understood that the mat panels 61,62 and 63, along with half panels 65,68 if desired, may be used in combination with one or more of the stance mats 22 and 25, and may be selectively positioned in any one of many possible configurations in the recess, to form any desired combination of different playing surface regions, such as those illustrated in FIGS. 1–11 and others. A kit will be provided with at least two each of the stance mats 22 and 25, along with a plurality of the different mat panels, so that the user can place the desired mats into the recess. If playing conditions are to be changed, the user simply removes or rearranges the mats and panels as desired. This arrangement is extremely flexible and easy to use.

As noted above, the dimensions of recess 18 may be selected as desired to provide the appropriate different surface regions, and the mat dimensions will be arranged according to the recess dimensions. In one particular example, a recess 18 of approximate dimensions 36" by 84" was provided. The following components were provided for selectively placing in the recess to provide a desired hitting surface configuration: Two foam-backed stance mats 22 of approximate dimensions 30" by 36", two foam-backed stance mats 25 of approximate dimensions 12" by 36", and a plurality of different mat panels of 12" by 12" square. One or more foam-backed stance mats 22 may be placed in the center of the recess to leave two strip-like regions at opposite ends of the recess, which may be filled with any desired combination of 12" by 12" mat panels. Alternatively, stance mats may be placed at opposite ends of the recess with any combination of mat panels at the center, for example as in FIG. 6. In another possible configurations, two mat panels 22 may be placed to extend from one end, with plural mat panels filling the free end of the recess. If desired, the entire recess may be filled by the two larger foam-backed stance mats 22 and the two smaller foam-backed stance mats 25. It is clear that many possible alternative configurations will be available to the user, making it possible to simulate a wide variety of different golf course playing conditions for better training.

It will be understood that various other configurations are possible, such as an all stance mat configuration using two stance mats 22 and two stance mats to fill recessed area 18, or combinations of stance mats with any combination of mat panels 61,62,63,65 or 68. In each case, a playing surface is provided which simulates desired playing conditions and which is substantially flush with the surrounding floor or ground area, putting the ball in a level and more realistic playing environment. The assembly provides a variety of different ball hitting locations which give a realistic feel of different ball hitting environments at different positions, depending on the selected mat combination and positions. This provides a realistic, easy to change, and easy to use ball hitting surface which may be readily used in golf ranges, hitting bays, golf game practice and golf simulators.

Although preferred embodiments of the invention have been described above by way of example only, it will be understood by those skilled in the field that modifications may be made to the disclosed embodiments without departing from the scope of the invention, which is defined by the appended claims.

I claim:

1. A golf ball playing surface assembly, comprising:

a substantially flat playing surface for golf having a rectangular recess of predetermined area, depth, length and width, the recess having a fixed, flat base recessed below the playing surface;

a plurality of different mats of smaller area than said recess for selectively placing on said base in different combinations in said recess for forming regions simulating at least two different playing conditions to fill at least a major portion of said recess;

the mats including a first mat having a first surface texture for simulating a tee area and additional mats having different surface textures for simulating other golf playing surface conditions;

at least said additional mats each comprising a unitary panel of square dimensions having a base and a plurality of bristles of predetermined height and density projecting upwardly from the base to simulate at least one golf playing surface condition; and said additional mats including a first panel having a first set of bristles of a first texture for simulating a first playing surface condition, and a second panel different from said first panel having a second set of bristles of a second texture for simulating a different golf playing condition from said first panel.

2. The assembly as claimed in claim 1, wherein said first set of bristles has a first height and density and said second set of bristles has a second height and density different from said first height and density.

3. The assembly as claimed in claim 1, wherein said additional panels further comprise a third mat panel having a third set of bristles of a third texture different from said first and second textures for simulating a different golf playing surface condition.

4. The assembly as claimed in claim 3, further comprising a plurality of first, second, and third mat panels having said first, second, and third surface textures, respectively, whereby any selected combination of said panels may be placed into said recess to provide different playing conditions.

5. The assembly as claimed in claim 4, wherein said first mat comprises a single piece of carpet material of larger dimensions than said panels, said piece having a width equal to the width of said recess and a length less than the length of said recess for leaving a strip-shaped region at least at one end of the recess for receiving a selected combination of said unitary, square panels, said first mat having a predetermined surface texture for simulating a tee area.

6. The assembly as claimed in claim 5, including a plurality of said first, second, and third panels, said first mat panels each having a first texture for simulating a fairway area, said second mat panels each having a second texture for simulating a rough area, and said third mat panels each having a third texture for simulating a sand area, whereby any selected combination of said mat panels may be selectively positioned in said strip-shaped region in different configurations.

7. The assembly as claimed in claim 6, wherein said different textures comprise piles of different height and density, said first texture being of a first pile height and density, said second texture being of a second pile height higher than said first pile height and a second pile density, said third texture being of a third pile height higher than said second pile height and a third pile density less than said second pile density.

8. The assembly as claimed in claim 1, wherein the panel dimensions are approximately 12" by 12".

9. A golf simulating apparatus, comprising:

a substantially flat playing surface having a forward end, a rear end, and opposite sides;

a target area at the forward end of the playing surface defining a playing direction towards said target area;

the playing surface having a rectangular recess of predetermined depth, length, and width, the recess having a substantially flat, fixed base spaced below said playing surface;

a plurality of different, unitary mat panels for selectively placing on said base in said recess for forming regions simulating different playing conditions, whereby a plurality of said mat panels substantially fill said recess;

each mat panel having a base and a plurality of bristles projecting upwardly from said base to form a pile of predetermined texture substantially flush with the surrounding flat playing surface; and the mat panels including at least one first mat panel having a first pile texture for simulating a tee area, and a plurality of second mat panels having a second pile texture different from said first pile texture for simulating a different golf playing surface condition.

10. The apparatus as claimed in claim 9, wherein the first mat panel is of larger area than said second mat panels, the recess having a predetermined length and width, the first mat panel having a width substantially equal to the width of said recess and a length less than the length of said recess so as to leave an elongate region at least at one end of said recess empty when said first mat panel is placed in said recess.

11. The apparatus as claimed in claim 10, wherein the second mat panels are of square shape and of predetermined dimensions whereby a plurality of said second mat panels fit in said elongate region at the end of said recess.

12. The apparatus as claimed in claim 11, wherein the mat panels further comprise a plurality of third mat panels having a third pile texture different from said first and second pile textures for simulating a different golf playing surface condition, the third mat panel being of square shape and of dimensions matching the dimensions of said second mat panel, whereby a selected combination of said second and third mat panels may be placed in said elongate region at the end of said first mat panel.

13. The apparatus as claimed in claim 12, wherein the mat panels further comprise a plurality of fourth mat panels having a fourth pile texture different from said first, second and third pile textures for simulating a different golf playing surface condition, the fourth mat panel being of square shape and of dimensions matching the dimensions of said second and third mat panels, whereby a plurality of different possible combinations of said second, third, and fourth mat panels may be placed in said recess with said first mat panel to provide different arrangements of golf playing surface regions.

14. The apparatus as claimed in claim 13, wherein the second pile texture is for simulating fairway, said third pile texture is for simulating rough, and said fourth pile texture is for simulating sand.

15. The apparatus as claimed in claim 9, including a plurality of additional mat panels having two halves with different pile textures in each half of the additional mat panel.

16. The apparatus as claimed in claim 15, wherein said additional mat panels include at least three different panels each having a different combination of pile textures in the two halves of its surface.

* * * * *